US007594975B2

(12) United States Patent
Hartman

(10) Patent No.: US 7,594,975 B2
(45) Date of Patent: Sep. 29, 2009

(54) RECYCLABLE TUFTED CARPET WITH IMPROVED STABILITY AND DURABILITY

(75) Inventor: David R. Hartman, Granville, OH (US)

(73) Assignee: OCV Intellectual Capital, LLC DE (US)

( * ) Notice: Subject to any disclaimer, the term of this patent is extended or adjusted under 35 U.S.C. 154(b) by 221 days.

(21) Appl. No.: 11/633,402

(22) Filed: Dec. 4, 2006

(65) Prior Publication Data

US 2007/0122586 A1 May 31, 2007

Related U.S. Application Data

(62) Division of application No. 10/827,497, filed on Apr. 19, 2004, now Pat. No. 7,160,599.

(51) Int. Cl.

| | |
|---|---|
| ***D05C 15/00*** | (2006.01) |
| ***D05C 15/04*** | (2006.01) |
| ***D05C 17/02*** | (2006.01) |
| ***B29C 65/02*** | (2006.01) |
| ***C08J 5/04*** | (2006.01) |

(52) U.S. Cl. ..... 156/72; 112/475.23; 156/244.11; 156/309.6; 428/95

(58) Field of Classification Search ..... 112/475.23; 442/394, 366, 367; 428/95, 105, 113, 114; 427/389.8, 389.9, 394; 156/72, 244.11, 308.2, 156/309.6; 28/159

See application file for complete search history.

(56) References Cited

U.S. PATENT DOCUMENTS

| | | | | |
|---|---|---|---|---|
| 3,533,893 | A | 10/1970 | Hartstein | |
| 3,642,516 | A | 2/1972 | Gasaway et al. | |
| 4,294,876 | A | 10/1981 | Camden et al. | |
| 4,689,256 | A | 8/1987 | Slosberg et al. | |
| 4,702,950 | A | 10/1987 | Slosberg et al. | |
| 5,470,648 | A | 11/1995 | Pearlman et al. | |
| 5,560,972 | A | 10/1996 | Blakely et al. | |
| 5,616,200 | A | 4/1997 | Hamilton et al. | |
| 5,693,400 | A | 12/1997 | Hamilton et al. | |
| 5,902,663 | A | 5/1999 | Justesen et al. | |
| 5,906,877 | A | 5/1999 | Popper et al. | |
| 5,939,166 | A | 8/1999 | Cheng et al. | |
| 5,962,101 | A | 10/1999 | Irwin et al. | |
| 6,299,959 | B1 | 10/2001 | Squires et al. | |
| 6,475,592 | B1 | 11/2002 | Irwin | |
| 6,479,125 | B1 | 11/2002 | Irwin, Sr. | |
| 2002/0119281 | A1 * | 8/2002 | Higgins et al. | 428/95 |
| 2003/0175474 | A1 | 9/2003 | Higgins et al. | |
| 2003/0175475 | A1 | 9/2003 | Higgins et al. | |

FOREIGN PATENT DOCUMENTS

| | | |
|---|---|---|
| EP | 0547533 | 6/1993 |
| EP | 580531 | 1/1994 |
| EP | 1076125 | 2/2001 |
| JP | 9140544 | 6/1997 |

* cited by examiner

*Primary Examiner*—Cheryl Juska
(74) *Attorney, Agent, or Firm*—James J. Dottavio; Kathryn W. Grant

(57) ABSTRACT

A recyclable tufted carpet meeting EPA recyclable content standards and having improved dimensional stability that reduces skew, bow, and wrinkles during manufacture and installation is formed by combining prior art primary and secondary backings into a single, fiber-reinforced primary backing layer. Consolidating either a glass fiber fabric layer, a glass veil, or a glass mat with a fiber-reinforced extruded film forms the fiber-reinforced primary backing layer. An additional glass fabric fiber layer can also be introduced to the primary backing to provide additional dimensional stability.

19 Claims, 7 Drawing Sheets

RECYCLABLE TUFTED CARPET WITH IMPROVED STABILITY AND DURABILITY

This application is a divisional of U.S. patent application Ser. No. 10/827,497, filed Apr. 19, 2004, now U.S. Pat. No. 7,160,599, which is hereby incorporated by reference in its entirety.

TECHNICAL FIELD AND INDUSTRIAL APPLICABILITY OF THE INVENTION

The present invention relates generally to carpets and more specifically to recyclable tufted carpets having improved stability and durability.

BACKGROUND OF THE INVENTION

The look of a particular carpet is determined by its construction that may be loop, cut or combinations of loop and cut. In corridors, offices, classrooms, hotel rooms, patient care, and other public areas, loop piles of low, dense construction, tent to retain appearance and resiliency and, generally, provide a better surface for the rolling traffic of wheelchairs and roll carts. Cut pile or cut and loop pile carpets are very good choices for administration areas, libraries, individual offices and boardrooms.

Carpet performance is associated, in part, with pile yarn density, which is defined as the amount of pile yarn per given volume of carpet face. For a given carpet weight, lower pile height and higher pile yarn density typically gives the best performance. The number of tufts per inch and the size of the yarn in the tufts also influence density.

Commercial carpet is primarily manufactured by tufting, weaving, and by fusion bonding processes. Tufted carpets are the most popular, and account for upwards of 95 percent of all carpet construction. The tufting process is generally considered the most efficient and has advanced technology to provide capability for a myriad of patterns and styles.

Tufted carpet generally comprises yarn, a tufting primary into which the yarn is tufted, a secondary backing, and a binder, normally latex, which bonds the yarn, tufting primary and secondary backing together. The yarn is typically nylon and can be in the form of cut pile or loop pile. Cut pile carpet is made of short cut lengths of yarn and loop pile carpet is made of long continuous lengths of yarn. The tufting primary is typically a thin sheet of woven polyester or polypropylene material and the secondary backing is usually jute, woven polypropylene, or polyvinyl chloride (PVC) sheet.

Conventional tufted carpets are made by passing a flexible woven primary backing through a tufting machine having a large array of needles that force the carpet multifilament yarn through the backing where the yarn is restrained by a large array of hooks before the needles are retracted. The backing must accommodate needle penetration without damage. The backing is then advanced a short distance (about 1/10" for a popular high quality tuft density), and the needles are reinserted through the backing to form the next series of yarn tufts. A large array of cutters may be employed in conjunction with the hooks to cut the tuft loop inserted through the backing to produce a cut-pile carpet. For loop-pile carpets, the tuft loops are not cut.

To assist in stabilizing, stiffening, strengthening, and protecting the tuft base from abrasion, a secondary backing is attached to the underside of the tufted primary backing. The secondary backing may be attached by the same adhesive layer or by the application of more adhesive. To save on costs, inexpensive latex adhesive is most often used. The secondary backing must resist damage during shipping, handling and installation.

Recent EPA requirements for recyclable carpeting require that carpet backings achieve at least 7% recyclable content. Traditional polypropylene type carpet backings do not currently meet this threshold requirement.

There is a need for a tufted carpet construction that is lightweight, dimensionally stable in use, and can be recycled easily to produce useful polymers and meet EPA recyclable content requirements. There is a need for an "all nylon and glass" tufted carpet that is stable to moisture and temperature changes in use. There is a need for a simple inexpensive method of making such tufted carpets. The present invention provides carpet backings for such carpets.

SUMMARY OF THE INVENTION

The present invention discloses a recyclable tufted carpet having improved dimensional stability that reduces skew, bow and wrinkles during manufacture and installation. The recyclable tufted carpet also does not creep after installation, therein providing improved durability.

The present invention combines the primary and secondary backings into a single fiber-reinforced primary backing layer that includes an adhesive for holding the tufts to the backing.

The present invention includes combination of the tufted primary and secondary backings with extruded nylon from, as needed, recycled nylon carpet.

The tufted carpet produced is fully recyclable, with only glass and nylon as its major components.

The present invention also discloses a fiber reinforced primary backing that can be used in forming a wide variety of carpets, including the recyclable tufted carpets described above and other types of open carpets.

The foregoing and other objects, features, and advantages of the invention will appear more fully hereinafter from a consideration of the detailed description that follows.

DETAILED DESCRIPTION AND PREFERRED EMBODIMENTS OF THE INVENTION

Figure 1:
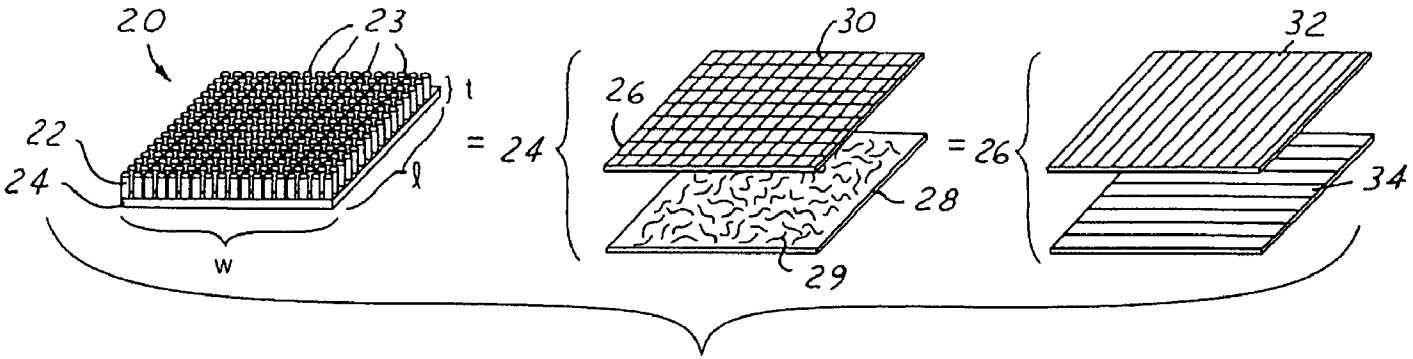
FIG. 1 is a perspective view of a preferred embodiment of the present invention.

In the following figures the same reference numerals will be used to refer to the same components.

Figure 4:
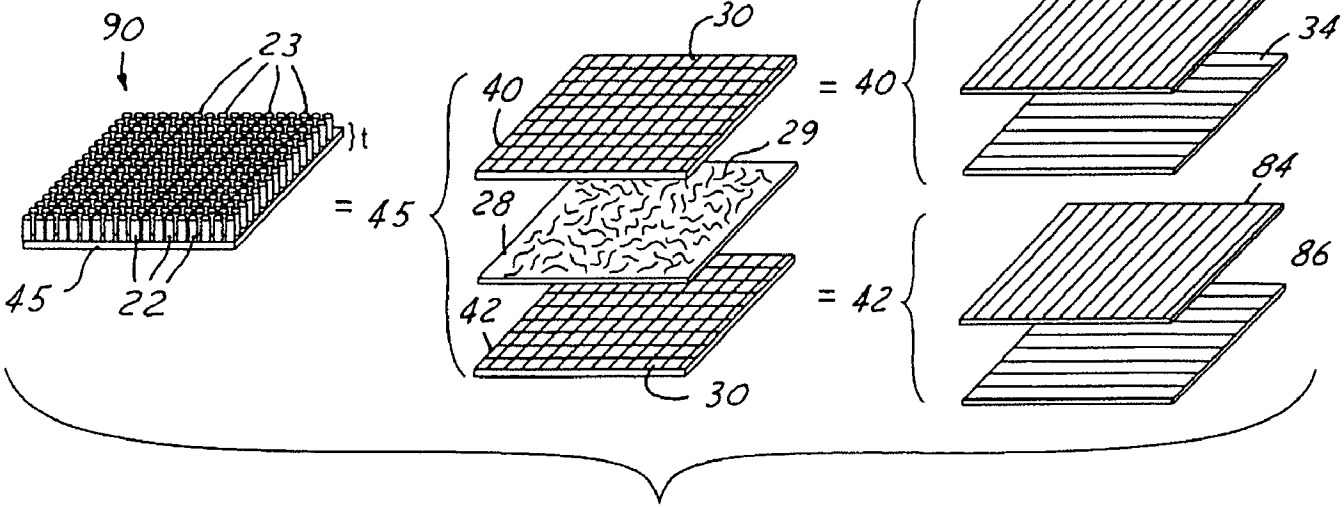
FIG. 4 is a perspective view of a preferred embodiment of the present invention.

FIGS. 1 and 4 illustrate two preferred embodiments of a recyclable carpet having improved dimensional stability that reduces skew, bow and wrinkles during manufacture and installation. The recyclable carpet also does not creep after installation, therein providing improved durability.

Referring now to FIG. 1, one preferred embodiment of the recyclable carpet 20 is shown having a plurality of pile elements 22 tufted within a primary backing layer 24. To form the fiber-reinforced primary backing layer 24, a layer of extruded film 28 is first applied to a glass fiber fabric layer 26. After the pile elements 22 have been tufted into the glass fabric fiber layer 26, the extruded film 28 is heated and consolidated therein forming the reinforced primary backing layer 24 having a length l and a width w. The thickness t of the fiber-reinforced primary backing layer 24 depends on the tufting density required and can range from 1 to 5 mm. The glass fiber fabric layer composition and weight also depends on the required nylon facing tuft density. The glass fiber layer in a non-woven discrete, random assembly combined by adhesive binder or stitched together with or without continuous fiber bundles.

The fabric layer 26 as shown in FIG. 1 is formed of a fabric glass fibers 30 layered in a 0/90 orientation that gives strength required during the tufting process. The 0/90 orientation also gives the backing layer 24 biaxial dimensional stability and minimizes creep and shrinkage as the extruded film 28 is consolidated with the fabric layer 26. A 0/90 orientation, a shown in FIG. 1, is defined for the purposes of the present invention as describing a first layer 32 of glass fibers 30 running parallel in a first direction (shown as top (or 0 degrees) to bottom (or 180 degrees) in FIG. 1) and a second layer 34 of glass fibers 30 layered onto the first layer 32 and running parallel and in a second direction (shown as right (or 90 degrees) to left (or −90 degrees) on FIG. 1), with the second layer 34 having fibers 30 rotated 90 degrees with respect to fibers 30 lying in the first layer 32. The first layer 32 of glass fibers 30 run generally parallel to the length l of the fabric 26 while the second layer 34 of glass fibers 30 run generally parallel to the width w of the fabric 26 and perpendicular to the length l of the fabric 26. Of course, in alternative arrangements, the first layer 32 may run parallel to the width w and the second layer 34 run parallel to the length l without affecting the properties of the primary backing 24 after consolidation. While FIG. 1 is described with respect to two layers 32, 34, it is understood that additional layers (not shown) that continue to alternate in a 0/90 pattern could be added to the glass fabric layer 26. For example, as shown below in FIGS. 2 and 3, four layers 64, 66, 68, 70 of glass fibers form the glass fabric 26.

In alternative embodiments, the glass fabric 26 may be formed of layers of fibers 30 oriented in a +45/−45 orientation. A +45 orientation, for the purposes of the present invention, is defined wherein the first layer 32 of glass fibers 30 are oriented to run from 45 degrees at top right to −135 degrees at bottom left. A +45 orientation is thus defined wherein the fibers in the first layer are rotated 45 degrees clockwise relative to fibers oriented in a 0 degree orientation. A −45 orientation, for the purposes of the present invention, is defined wherein the second layer 34 of glass fibers 30 are oriented to run from −45 degrees at top right to +135 degrees at bottom left. A −45 orientation is thus defined wherein the fibers in the first layer are rotated 45 degrees counterclockwise relative to fibers oriented in a 0 degree orientation. The +45/−45 orientation thus appears to form an X-shape as compared with the length l and width w of the fabric 26, while fibers oriented in a 0/90 appear to form a cross-shape relative to the length l and width w. As above, additional layers (not shown) that continue to alternate in a +45/−45 pattern could be added to the glass fabric layer 26.

Further, in yet another alternative embodiment, the layers of glass fibers 30 forming the glass fabric 26 may take on any of a number of other alternative arrangements to give the primary backing a varying degree of dimensional stability depending upon the desired end use. For example, a four-layer glass fabric 26 may have a 0/+45/90/−45 orientation. In addition, other fiber orientations, such as a +30 or −65 orientation, may also be utilized in one or more of the layers.

The extruded film 28 preferably is formed of nylon 6, nylon 66 and copolymers thereof. The extruded film also preferably incorporates recycled glass fibers 29. The glass content of the extruded film 28 adds additional strength properties and creep resistance in the formed backing 24. The extruded film 28 provides dispersed fibers and friction that helps to hold the tufted pile elements 22 during the tufting process and permanently hold (adhere to) the tuft pile elements 22 after consolidation. The extruded film 28 thus aids in improving durability of the finished carpet 20.

The pile elements 22 are tufted yarn, preferably tufted nylon that are in the form of a cut pile or loop pile. The pile elements 22 are tufted into the backing 24 in conventional tufting patterns using conventional tufting equipment well known to those of ordinary skill in the art. In the illustrations provided (as shown in FIGS. 1-13), the pile elements 22 of the recycled carpet are shown in a cut-pile arrangement, and thus illustrate wherein the cut ends 23 of the pile elements extend above the surface of the backing 24 to a desired pile height. While not shown, the pile elements 22 of the recycled carpet could also remain in a loop-pile arrangement, wherein the loops are not cut above the surface of the backing, but instead loop continuously through the backing for each row of tufts.

The fibers 30 are preferably continuous glass fibers, sized or unsized, having a diameter of about 10-24 micrometers formed in conventional fiber forming operations.

The process for forming the glass fabric 26 of FIG. 1 is described below with respect to FIG. 2, while the process for forming the recyclable carpet 20 from the glass fabric 26 is described in FIG. 3.

Figure 2:
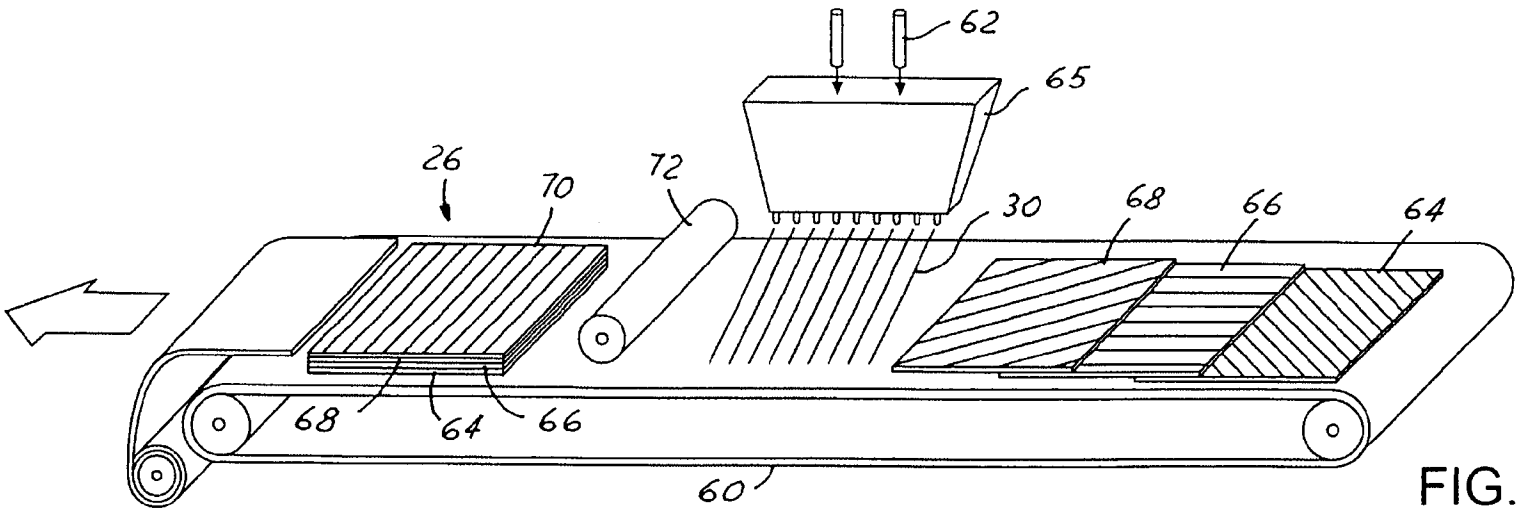
FIG. 2 is a perspective view of the process for forming the glass fabric depicted in FIG. 1.

Referring now to FIG. 2, a process for forming the glass fabric 26 of FIG. 1 is depicted. Glass rods 62, preferably about 2000 mm by 5 mm, are first melted and spun within a conventional device 65 to produce attenuated glass fibers 30 (sized or unsized) having a diameter of between about 10 and 24 micrometers. The glass fibers 30 are then introduced onto a perforated moving belt 60 in layer form at a desired fiber layer orientation. For example, as shown in FIG. 3, three layers 64, 66, 68 of glass fibers are depicted previously introduced from bottom to top in an (−45/90/+45) orientation. A fourth layer 70 of glass fiber 30 is shown as being introduced in the 0 orientation. The layers 64, 66, 68, 70 are compacted under a roller 72. Of course, the number of layers of fibers 30, and the respective orientations, is a matter of design choice based on numerous factors, including mechanical properties and cost.

Next, the fiber fabric 26 is passed through a conventional tufting machine 100 having a large array of needles that force the carpet multifilament yarn 22 through the fabric 26 where the yarn 22 is restrained by a large array of hooks before the needles are retracted. This forms a tufted fiber fabric 75. The fabric 26 must accommodate needle penetration without damage. The fabric 26 is then advanced a short distance (about 1/10" for a popular high quality tuft density), and the needles are reinserted through the fabric 26 to form the next series of yarn tufts. A large array of cutters may be employed in conjunction with the hooks to cut the tuft loop 22 inserted through the fabric 26 to produce a cut-pile carpet having ends 23 extending above the tufted fiber fabric 75. For loop-pile carpets, the tuft loops are not cut.

Figure 3:
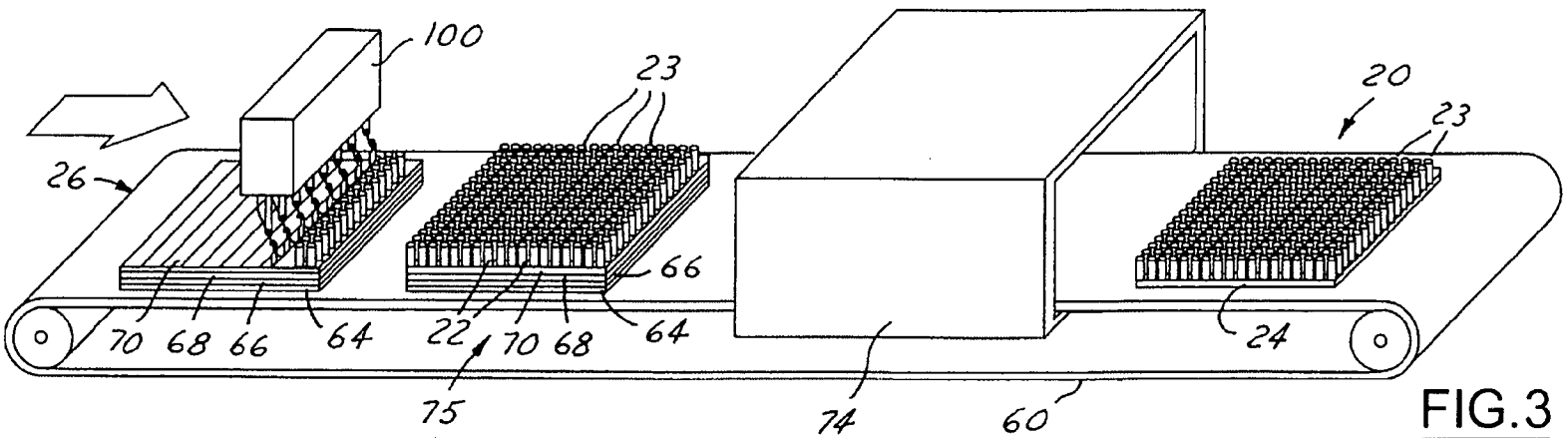
FIG. 3 is a perspective view of the continuation of the process, depicted in FIG. 2, for forming the glass fabric depicted in FIG. 1.

Next, as shown in FIG. 3, a layer of extruded film 28 is introduced onto the tufted glass fabric layer 75 produced in FIG. 2. The extruded film 28 and tufted glass fabric layer 75 then pass through an oven 74, or otherwise heated, wherein the nylon component of the extruded film 28 melts to consolidate the layers 64, 66, 68, 70 to form the fiber-reinforced primary backing layer 24. The oven 74 temperature is insufficient to melt the tufted pile elements 22. In an alternative method, the extruded film 28 could be introduced directly from an extruder onto the tufted glass fabric layer 75 in melted form, thus eliminating the need for an oven 74.

In an alternative preferred embodiment, as shown in FIG. 4, another preferred embodiment of the recyclable carpet 90 is shown having a plurality of pile elements 22 tufted within a primary backing layer 45.

To form the fiber-reinforced primary backing layer 45, a layer of extruded film 28 is first sandwiched between a pair of glass fiber fabric layers 40, 42. The extruded film 28 and fiber layers 40, 42 are then heated to consolidate the fiber layers 40, 42 together to form a fiber-reinforced primary backing layer 45 having a length l and a width w. The thickness t of the fiber-reinforced primary backing layer 45 is between about 1 to 5 mm. Finally, a plurality of pile elements 22 are tufted within the backing layer 45 in a desired warp and weft knitting pattern to form the recyclable carpet 90.

The layers of glass fabric 40, 42 are formed in the same manner as glass fabric 26 in FIG. 1. The glass fabric 40, 42 have a varying number of potential layers of glass fibers 30 oriented in various directions. In a preferred arrangement, to maximize dimensional stability for the recycled carpet 90, the fibers 30 of the glass fabric 40 are oriented in a 0/90 orientation while the fibers 30 of the glass fabric 42 are oriented in either a 0/90 or +45/−45 orientation. The process for forming a recyclable carpet 90 having the fiber-reinforced backing layer 45 is described below in FIGS. 5 and 6.

Figure 5:
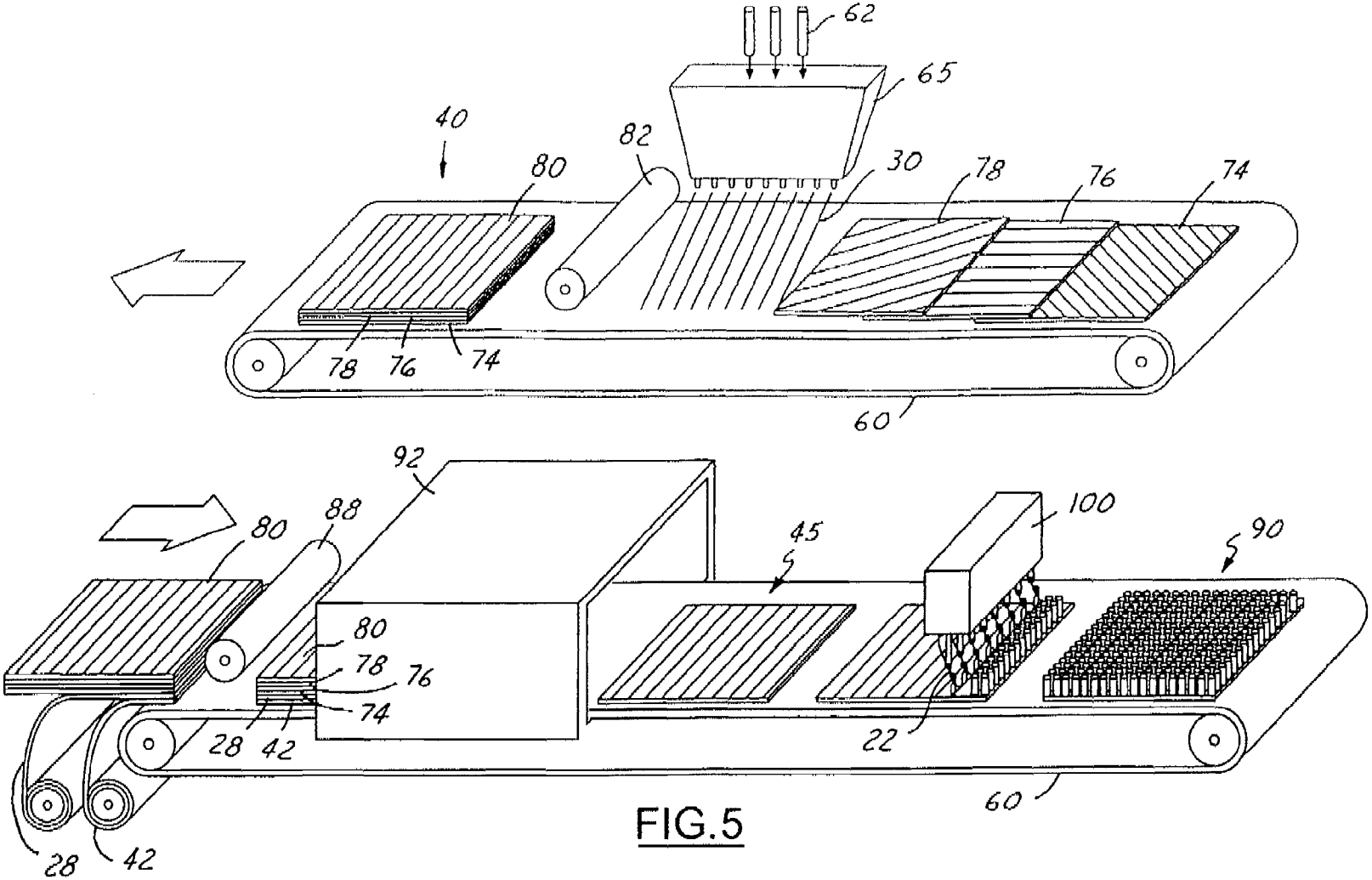
FIG. 5 is a perspective view of a process for forming the carpet depicted in FIG. 4.

Referring now to FIG. 5, one method for forming the recyclable carpet 90 of FIG. 4 is illustrated. First, the glass fabric layer 40 is formed according to the process described above with respect to the formation of the glass fabric 26 of FIG. 2. Thus, glass rods 62, preferably about 2000 mm by 5 mm, are first melted and spun within a conventional device 65 to produce attenuated glass fibers 30 (sized or unsized) having a diameter of between about 10-24 micrometers. The glass fibers 30 are then introduced onto a perforated moving belt 60 in layer form at a desired fiber layer orientation. For example, as shown in FIG. 3, three layers 74, 76, 78 of glass fibers 30 are depicted previously introduced from bottom to top in a −45/90/+45 orientation. A fourth layer 80 of glass fiber 30 is shown as being introduced in the 0 orientation. The layers 74, 76, 78, 80 are compacted under a roller 82 to form the glass fiber fabric 40.

A layer of extruded film 28 is unrolled and applied onto the glass fabric layer 40 and the additional attenuated glass fiber layers 84, 86 forming glass fabric layer 42 are layered onto the extruded film 28 in a similar process as described above with respect to fabric layer 40. The material is then pulled under roller 88 to form a sandwich having the extruded film sandwiched between fiber layers 40, 42. For illustrative purposes, fiber layer 84 is shown having a 0 orientation, while fiber layer 86 is shown in a +90 orientation, thus fabric layer 42 is illustrated in FIG. 5 as having a 0/+90 orientation.

In alternative arrangements, as one of ordinary skill appreciates, the fabric layers 40, 42 could be preformed in an off-line process and introduced onto the moving belt 60 in one piece.

The sandwich of fabric layers 40, 42 and extruded film 28 are then introduced to oven 92, wherein the nylon component of the extruded film 28 melts and consolidates fiber layers 40, 42 together to form the fiber-reinforced primary backing layer 45. Again, as described above in FIG. 3, the extruded film 28 could be introduced directly from an extruder onto the fabric layer 40 in melted form and fabric layer 42 unrolled onto the melted extruded film 28. The nylon component would then consolidate layer 40 to layer 42 to form the fiber-reinforced primary backing 45 without the need for oven 92.

Finally, backing layer 45 is passed through a conventional tufting machine 100 having a large array of needles that force the carpet multifilament yarn pile elements 22 through the backing layer 45 where the yarn 22 is restrained by a large array of hooks before the needles are retracted. The backing layer 45 must accommodate needle penetration without damage. The backing layer 45 is then advanced a short distance (about 1/10" for a popular high quality tuft density), and the needles are reinserted through the backing layer 45 to form the next series of yarn tuft pile elements 22. A large array of cutters may be employed in conjunction with the hooks to cut the tuft loops 22 inserted through the backing 45 to produce a cut-pile recyclable carpet 90 having ends 23 extending above the backing layer 45. For loop-pile carpets, the tuft loops are not cut.

The extruded film 28 provides dispersed fibers 29 and friction that helps to hold the tufted pile elements 22 during the tufting process and permanently hold (adhere to) the tuft pile elements 22 to the fiber-reinforced backing layer 45.

Figure 6:
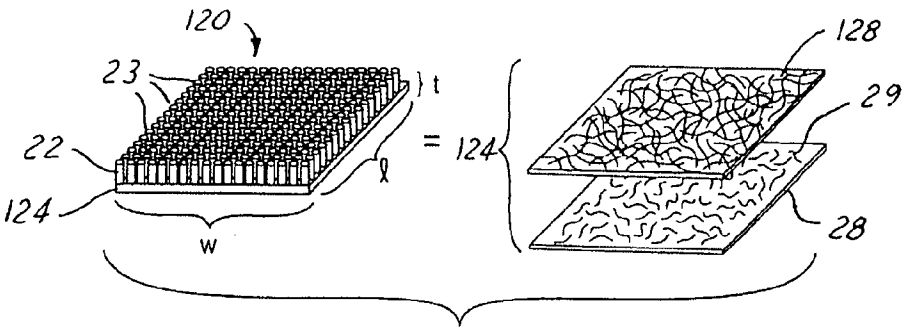
FIG. 6 is a perspective view of a another embodiment of the present invention.
Figure 7:
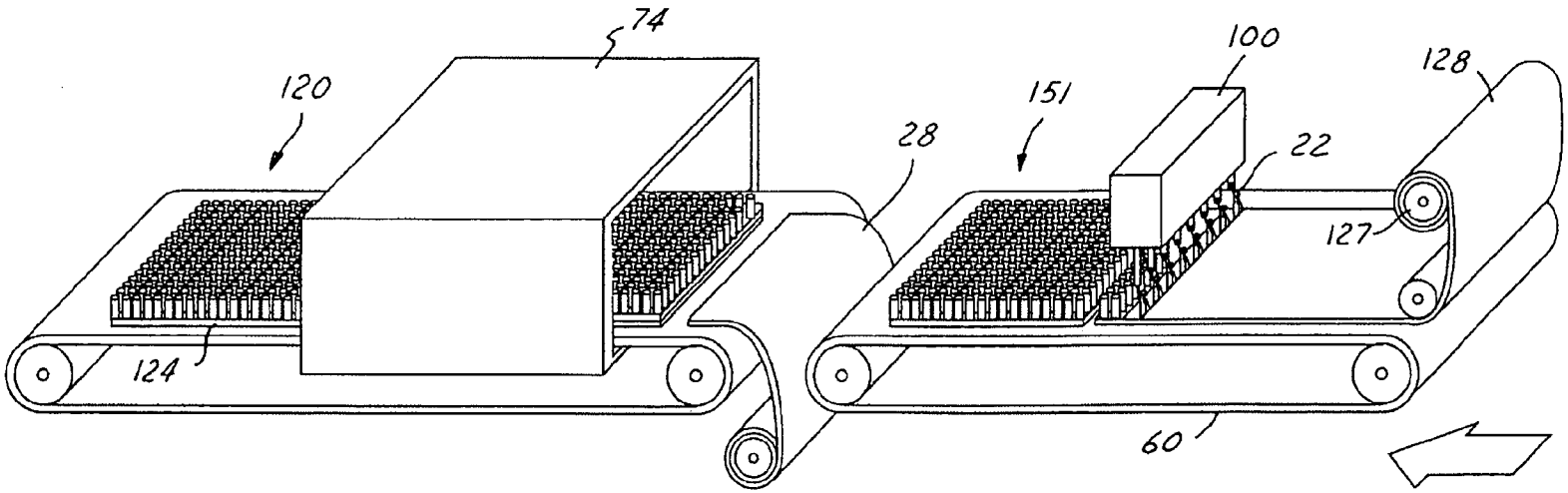
FIG. 7 is a perspective view of a process for forming the carpet depicted in FIG. 6.
Figure 8:
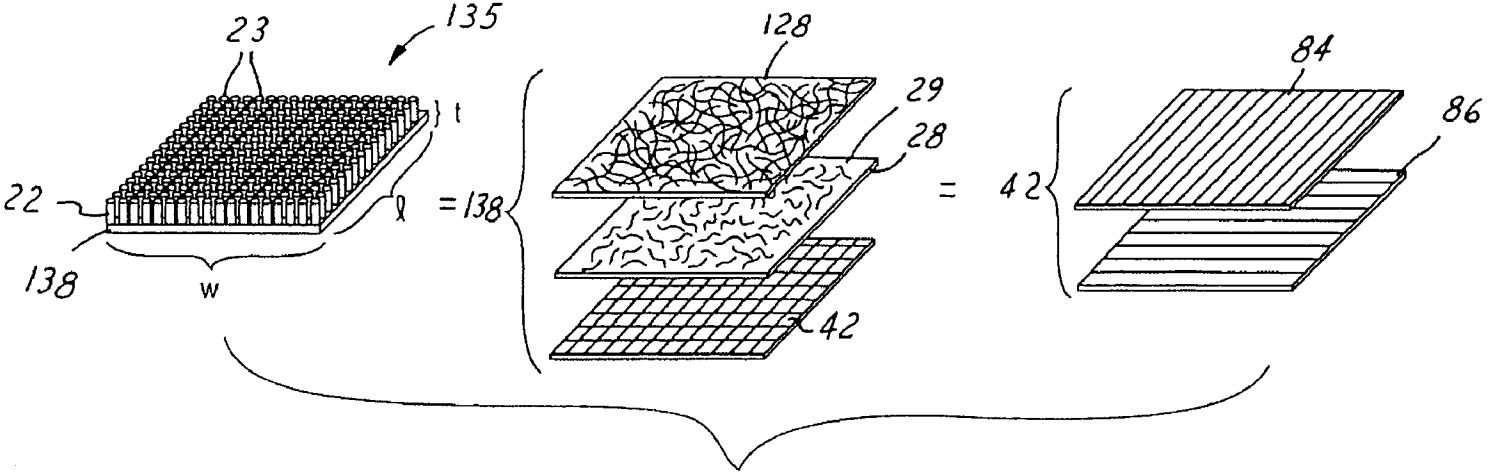
FIG. 8 is a perspective view of another embodiment of the present invention.
Figure 9:
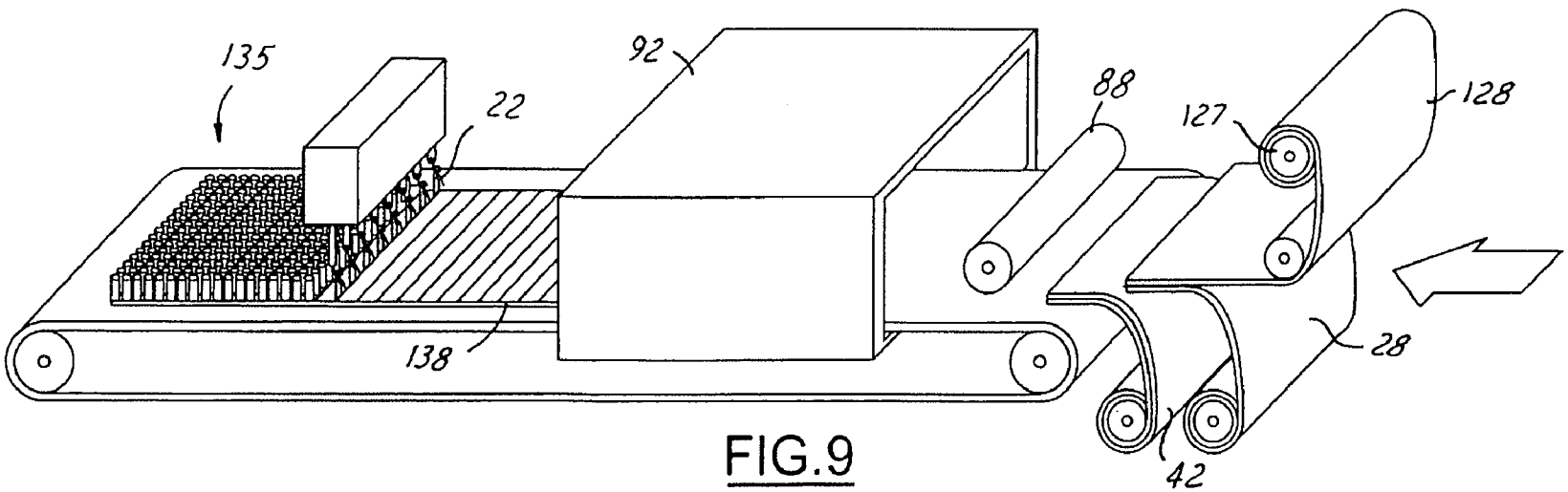
FIG. 9 is a perspective view of a process for forming the carpet depicted in FIG. 8.
Figure 10:
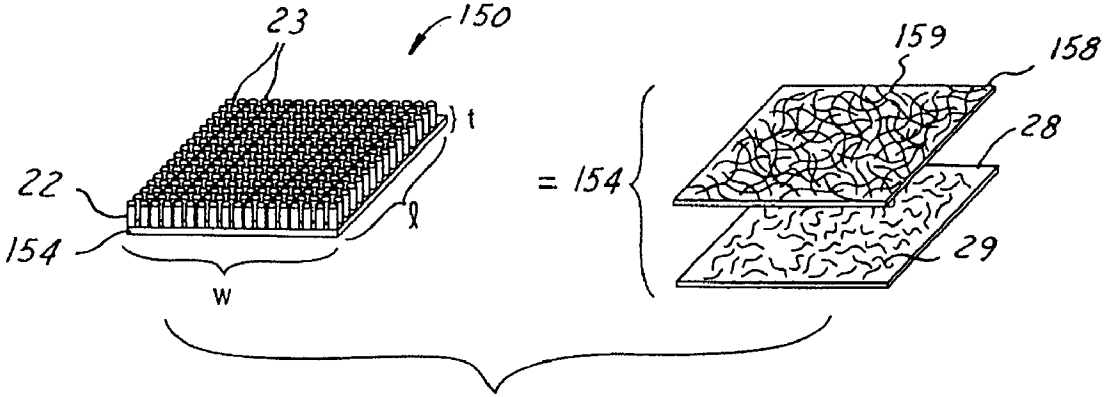
FIG. 10 is a perspective view of another embodiment of the present invention.
Figure 11:
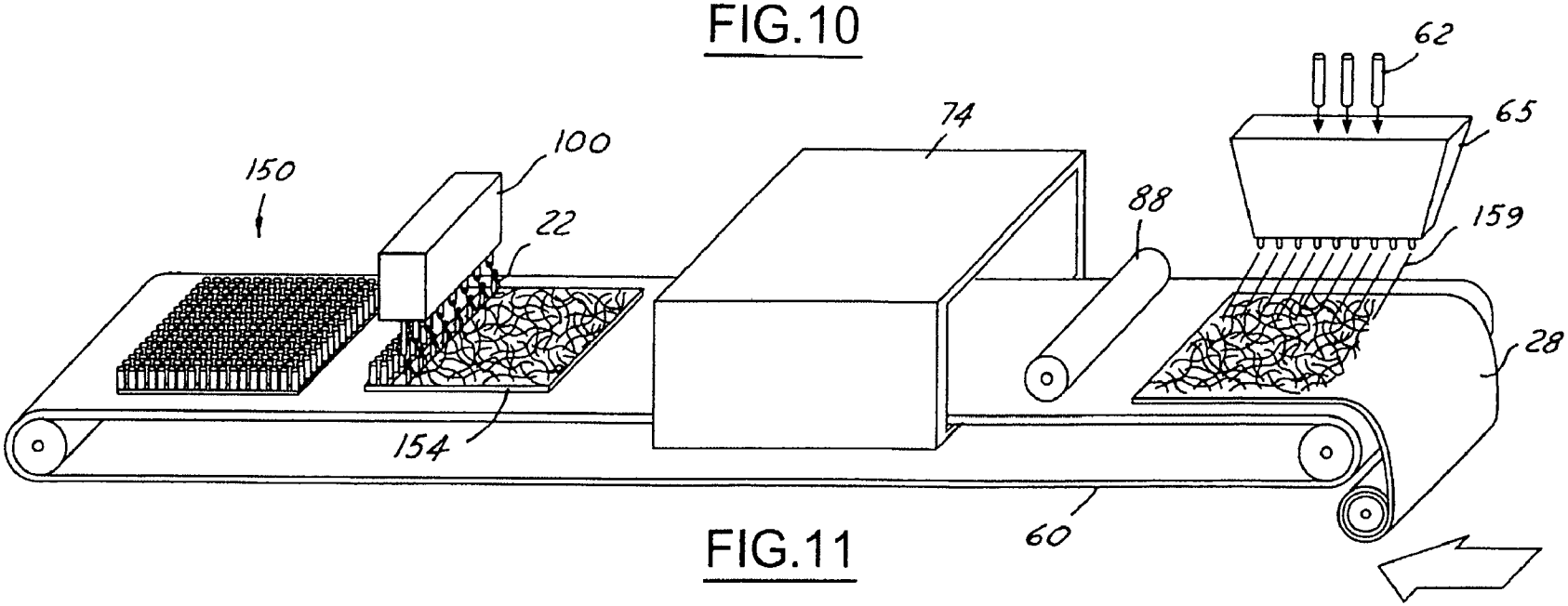
FIG. 11 is a perspective view of a process for forming the carpet depicted in FIG. 10.
Figure 12:
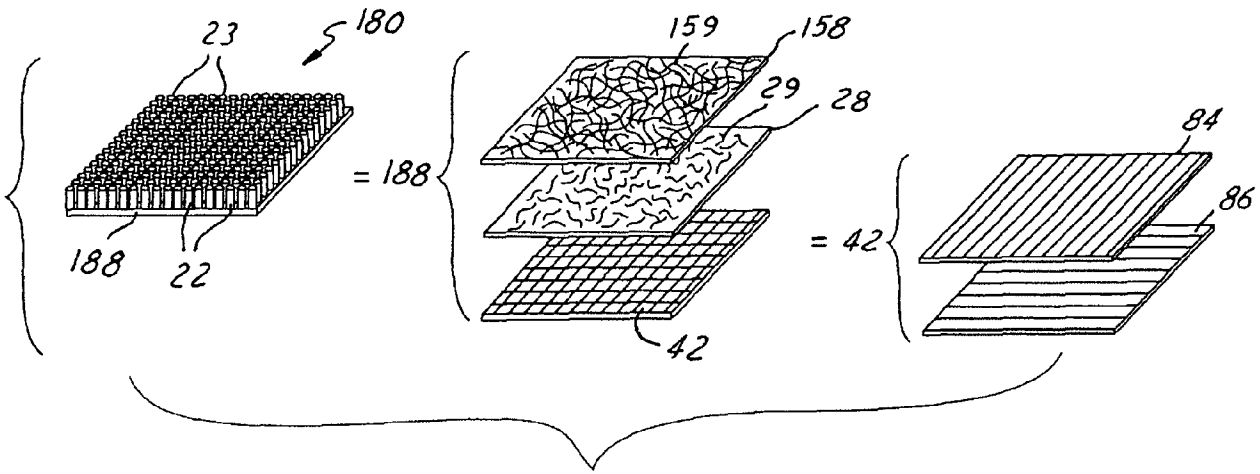
FIG. 12 is a perspective view of another embodiment of the present invention.
Figure 13:
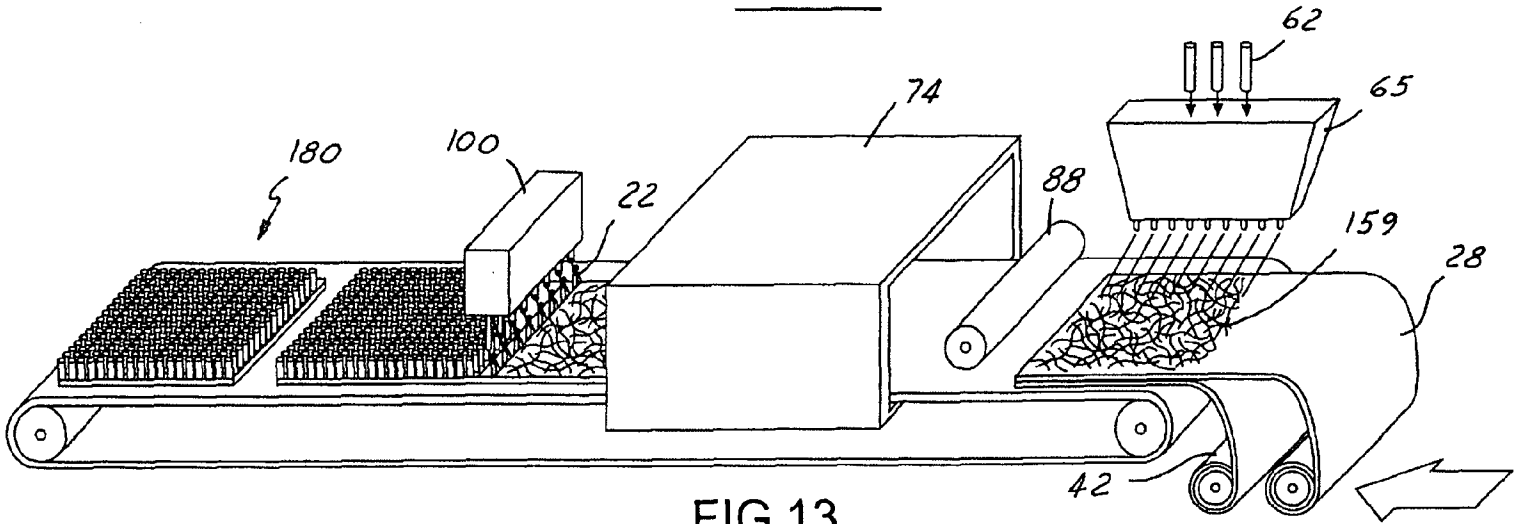
FIG. 13 is a perspective view of a process for forming the carpet depicted in FIG. 12.

FIGS. 6 and 8 illustrate two other preferred embodiments of the present invention, in which a low cost veil 128 replaces the glass fabric layers 26 in the recyclable carpets of the embodiments of FIGS. 1 and 4, respectively. FIGS. 7 and 9 describe the method for forming the respective recyclable carpets of FIGS. 6 and 8. In addition, FIGS. 10 and 12 illustrate two more preferred embodiments, in which a low cost glass mat replaces the glass fabric layers of FIGS. 1 and 4, respectively. FIGS. 11 and 13 describe the method for forming the respective recyclable carpets of FIGS. 10 and 12. Each is described below:

Referring now to FIG. 6, the recyclable carpet 120 is shown having a plurality of pile elements 22 tufted within a primary backing layer 124. To form the fiber-reinforced primary backing layer 124, a layer of extruded film 28 is first applied to a glass veil 128. The extruded film 28 could be applied as a film or applied in melted form and consolidated. After the pile elements 22 have been tufted into the veil 128, the extruded film 28 is heated and consolidated therein forming the reinforced primary backing layer 124 having a length l and a width w. The thickness t of the fiber-reinforced primary backing layer 124 depends on the tufting density required and can range from 1 to 5 mm. The veil composition and weight also depends on the required nylon facing tuft density.

The glass veil 128 is preferably a commercially available glass veil formed via conventional wet-laid or dry-laid methods. The veils may be formed as part of the manufacturing process described below or be preformed and stored on a roll.

Commercially available glass veils are formed, via a wet-laid process, by introducing a plurality of glass fibers and a bicomponent fiber to a whitewater chemical dispersion to form a thick whitewater slurry at consistency levels of approximately 0.2 to 1 percent. The thick slurry formed is maintained under agitation in a single tank and delivered to a former. The former, or headbox, functions to equally distribute and randomly align the fibers onto a moving woven fabric, or forming wire, therein forming the filament network. Formers that can accommodate the initial fiber formation include Fourdrinier machines, Stevens Former, Roto Former, Inver Former, cylinder, and VertiFormer machines. These formers offer several control mechanisms to control fiber orientation within the network such as drop leg and various pond regulator/wall adjustments.

Deposited fibers forming the network are partially dried over a suction box. The dewatered network is then run through a drying oven at a temperature sufficient to remove any excess water and sufficient to melt the sheath of the bicomponent fiber without melting the core of the bicomponent fiber. Upon removal from the oven, the sheath material cools and adheres to both the core and to the structural fibers, therein forming a conformable surfacing veil.

In a dry-laid process, glass rods, preferably about 2000 mm by 5 mm, are first melted and spun within a conventional device to produce glass fibers 30 having a diameter of between about 11 and 14 micrometers. The fibers are then introduced to oscillating (latitudinal) multiple fiber distribution heads that buildup a random mat of chopped glass fibers on a moving perforated conveyor belt with a down draft airflow. Air drawn through the perforated belt is used to allow the chopped fibers to lie down on the conveyor belt to form the random mat.

The mat is then impregnated with a binder from a curtain coater or similar application device to form an impregnated mat. The impregnated mat is then introduced to an oven, or furnace, wherein water is removed. The binder is melted within the oven to glue the fibers together, therein forming a smooth veil of fibers (i.e. a veil similar to 128).

Referring now to FIG. 7, a method for forming the recyclable carpet 120 of FIG. 6 begins by introducing the glass veil 128 a perforated moving belt 60. As described above, the glass veil 128 may be formed as part of the processing line or produced prior to and stored on rolls 127. Next, the glass veil 128 is passed through a conventional tufting machine 100 having a large array of needles that force the carpet multifilament yarn 22 through the veil 128 where the yarn 22 is restrained by a large array of hooks before the needles are retracted. This forms a tufted fiber fabric 151. The veil 128 must accommodate needle penetration without damage. The veil 128 is then advanced a short distance (about 1/10" for a popular high quality tuft density), and the needles are reinserted through the veil 128 to form the next series of yarn tufts. A large array of cutters may be employed in conjunction with the hooks to cut the tuft loop 22 inserted through the veil 128 to produce a cut-pile carpet having ends 23 extending beyond the veil 128. For loop-pile carpets, the tuft loops are not cut.

Next, a layer of extruded film 28 is introduced onto the tufted glass fabric layer 151. The extruded film 28 and tufted glass fabric layer 151 then pass through an oven 74, or otherwise heated, wherein the nylon component of the extruded film 28 melts to consolidate the film 28 to the veil 128 to form the recyclable carpet 120 having a fiber-reinforced primary backing layer 124. The oven 74 temperature is insufficient to melt the tufted pile elements 22 and the veil 128. Again, as similarly described above with respect to FIGS. 3 and 5, the extruded film 28 may be applied to the tufted glass fabric layer 151 and consolidated to the tufted glass fabric layer 151 without the need for oven 74.

In an alternative preferred embodiment, as shown in FIG. 8, another preferred embodiment of the recyclable carpet 135 is shown having a plurality of pile elements 22 tufted within a primary backing layer 138.

To form the fiber-reinforced primary backing layer 138, a layer of extruded film 28 is first sandwiched between the veil 128 and fabric layer 42. The extruded film 28 may alternatively be introduced in melted form from an extruder onto the fabric layer 42 and consolidated prior to introducing the veil 128. The veil 128, extruded film 28 and fiber layer 42 are then heated to consolidate the veil 128 and fiber layer 42 together to form a fiber-reinforced primary backing layer 138 having a length l and a width w. The thickness t of the fiber-reinforced primary backing layer 138 is between about 1 to 5 mm. Finally, a plurality of pile elements 22 are tufted within the backing layer 138 in a desired warp and weft knitting pattern to form the recyclable carpet 135.

The layer of glass fabric is formed in the same manner as glass fabric 42 in FIG. 5. The glass fabric 42 has a varying number of potential layers of glass fibers 30 oriented in various directions. In a preferred arrangement, to maximize dimensional stability for the recycled carpet 135, the fibers 30 of the glass fabric 42 are layered in either a 0/90 (shown here) or +45/−45 orientation. The process for forming a recyclable carpet 135 having the fiber-reinforced backing layer 138 is described below in FIG. 9.

Referring now to FIG. 9, one method for forming the recyclable carpet 135 of FIG. 8 is illustrated. First, the veil 128 is formed according to the process described above with respect to FIG. 7. The veil 128 is then introduced onto a perforated moving belt 60.

A layer of extruded film 28 is unrolled and applied onto the additional attenuated glass fiber layers 84, 86 forming the glass fabric layer 42. The veil 128 is then layered onto the extruded film 28 in a similar process as described in FIG. 5. The extruded film 28 may alternatively be introduced in melted form from an extruder onto fabric layer 42 and consolidated prior to introducing the veil 128. The material is then pulled under roller 88 to form a sandwich having the extruded film 28 sandwiched between the veil 128 and fiber layer 42. For illustrative purposes, fiber layer 84 is shown having a 0 orientation, while fiber layer 86 is shown in a +90 orientation, thus fabric layer 42 is illustrated in FIG. 8 as having a 0/+90 orientation.

The sandwich of veil 128, extruded film 28, and fabric layer 42 is then introduced to oven 92, wherein the nylon component of the extruded film 28 melts and consolidates the veil 128 and fabric layer 42 together to form the fiber-reinforced primary backing layer 138.

Finally, backing layer 138 is passed through a conventional tufting machine 100 having a large array of needles that force the carpet multifilament yarn pile elements 22 through the backing layer 138 where the yarn 22 is restrained by a large array of hooks before the needles are retracted. The backing layer 138 must accommodate needle penetration without damage. The backing layer 138 is then advanced a short distance (about 1/10" for a popular high quality tuft density), and the needles are reinserted through the backing layer 138 to form the next series of yarn tuft pile elements 22. A large array of cutters may be employed in conjunction with the hooks to cut the tuft loops 22 inserted through the backing 138 to produce a cut-pile recyclable carpet 90 having ends 23 extending above the backing 138. For loop-pile carpets, the tuft loops are not cut.

The extruded film 28 provides dispersed fibers 29 and friction that helps to hold the tufted pile elements 22 during the tufting process and permanently hold (adhere to) the tuft pile elements 22 to the fiber-reinforced backing layer 138.

In another preferred low cost alternative, as shown in FIG. 10, a mat 158 replaces the veil 128 in forming the fiber-reinforced backing layer 154 that is used to form a recyclable carpet 150. The mat 158 is formed of a plurality of randomly oriented glass fibers 159. The randomly oriented glass fibers 159 are preferably attenuated glass fibers 159 (sized or unsized) having a diameter of between about 10 and 24 micrometers.

To form the recyclable carpet 150 of FIG. 10, as shown in FIG. 11, a layer of extruded film 28 is unrolled onto a moving conveyor belt 60. At the same time, glass rods 62, preferably about 2000 mm by 5 mm, are melted and spun within a conventional device 65 to produce attenuated glass fibers 159 (sized or unsized) having a diameter of between about 10 and 24 micrometers. The glass fibers 159 are chopped and then introduced onto extruded film 28 in random fashion, therein forming a mat 158 on the extruded film 28. The extruded film 28 and mat 128 are then pressed through a roller 88 and consolidated in an oven 74 to form the fiber-reinforced backing layer 154.

Next, the layer 154 is passed through a conventional tufting machine 100 having a large array of needles that force the carpet multifilament yarn 22 through the layer 154 where the yarn 22 is restrained by a large array of hooks before the needles are retracted. The layer 154 must accommodate needle penetration without damage. The layer 154 is then advanced a short distance (about 1/10" for a popular high quality tuft density), and the needles are reinserted through the layer 154 to form the next series of yarn tufts. A large array of cutters may be employed in conjunction with the hooks to cut the tuft loop 22 inserted through the mat 154 to produce a cut-pile carpet 150 having ends 23 extending above the mat 154. For loop-pile carpets, the tuft loops are not cut.

Referring now to FIG. 12 another preferred embodiment of the recyclable carpet 180 is shown having a plurality of pile elements 22 tufted within a primary backing layer 188.

To form the fiber-reinforced primary backing layer 188, a layer of extruded film 28 is first sandwiched between the mat 158 and fabric layer 42. The mat 158, extruded film 28 and fiber layer 42 are then heated to consolidate the mat 158 and fiber layer 42 together to form a fiber-reinforced primary backing layer 188 having a length l and a width w. The thickness t of the fiber-reinforced primary backing layer 188 is between about 1 to 5 mm. Finally, a plurality of pile elements 22 are tufted within the backing layer 188 in a desired warp and weft knitting pattern to form the recyclable carpet 180.

Referring now to FIG. 13, to form a recyclable carpet 180 having a fiber-reinforced primary backing layer 188 as in FIG. 12. First, glass rods 62, preferably about 2000 mm by 5 mm, are melted and spun within a conventional device 65 to produce attenuated glass fibers 30 (sized or unsized) having a diameter of between about 10-24 micrometers. The glass fibers 30 are then introduced onto a perforated moving belt 60 in random fashion to form the mat 158.

A layer of extruded film 28 is unrolled and applied onto the mat 158 and the additional attenuated glass fiber layers 84, 86 forming glass fabric layer 42 are layered (here shown as previously formed) onto the extruded film 28 having the desired layered fiber orientation. Again, as described previously, the film 28 could be introduced onto the fabric layer 42 in molten form and consolidated to the mat 158 directly without the need for oven 74. The material is then pulled under roller 88 to form a sandwich having the extruded film 28 sandwiched between mat 158 and fiber layer 42. For illustrative purposes, fiber layer 84 is shown having a 0 orientation, while fiber layer 86 is shown in a +90 orientation, thus fabric layer 42 is illustrated in FIG. 5 as having a 0/+90 orientation.

The sandwich of mat 158, extruded film 28, and fiber layer 42 is then introduced to oven 74, wherein the nylon component of the extruded film 28 melts and consolidates the mat 158 and fiber layer 42 together to form the fiber-reinforced primary backing layer 188.

Finally, backing layer 188 is passed through a conventional tufting machine 100 having a large array of needles that force the carpet multifilament yarn pile elements 22 through the backing layer 82 where the yarn 22 is restrained by a large array of hooks before the needles are retracted. The backing layer 188 must accommodate needle penetration without damage. The backing layer 188 is then advanced a short distance (about 1/10" for a popular high quality tuft density), and the needles are reinserted through the backing layer 188 to form the next series of yarn tuft pile elements 22. A large array of cutters may be employed in conjunction with the hooks to cut the tuft loops 22 inserted through the backing 188 to produce a cut-pile recyclable carpet 180 having ends 23 extending above the backing 188. For loop-pile carpets, the tuft loops are not cut.

The extruded film 28 helps to hold the tufted pile elements 22 during the tufting process and permanently hold (adhere to) the tuft pile elements 22 to the fiber-reinforced backing layer 180. Dispersed fibers 29 within the extruded film 28 provides friction that further aids in holding the tufted pile elements during the tufting process.

The recyclable carpets 20, 90, 120, 135, 150, 180 formed according to these preferred embodiments have improved dimensional stability that reduces skew, bow and wrinkles during manufacture and installation. The recyclable carpet 20, 90, 120, 135, 150, 180 also does not creep after installation, therein providing improved durability. Further, the recyclable carpet 20, 90, 120, 135, 150, 180 constructions is lightweight and can be recycled easily to produce useful polymers and meet EPA recyclable content requirements. Further, the recyclable carpets 20, 90, 120, 135, 150, 180 are stable to moisture and temperature changes in use. In addition, by combining the primary and secondary backing into a single backing layer, manufacturing costs associated with reducing one step of the manufacturing process are realized.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

The invention claimed is:

1. A method for forming a recyclable tufted carpet comprising:

forming a fiber-reinforced primary backing, said fiber-reinforced backing including a fiber layer and an extruded film, said extruded film comprising a nylon film selected from the group consisting of a nylon 6 film, a nylon 66 film, and copolymers thereof; and tufting a plurality of pile elements tufted through said fiber-reinforced primary backing, wherein said extruded film includes a plurality of dispersed glass fibers incorporated therein.

2. The method of claim 1, wherein forming a fiber-reinforced primary backing comprises:

forming a glass fabric fiber layer, wherein said glass fabric fiber layer comprises a first layer formed of a plurality glass fibers, each of said plurality of glass fibers of said first layer running in a first direction, said first direction defined relative to a length and a width of the recyclable carpet; and a second layer of said plurality of glass fibers onto the first layer, each of said plurality of glass fibers of said second layer running in a second direction, said second direction also defined relative to said length and said width of the recyclable carpet;

coupling a fiber-reinforced extruded film to said glass fabric layer; and consolidating said fiber-reinforced extruded film to said glass fabric layer.

3. The method of claim 2, wherein said first direction runs in a 0 degree orientation and wherein said second direction runs in a 90 degree orientation, wherein a 0 degree orientation is defined wherein said plurality of fibers within a respective layer run parallel to said length of the recyclable carpet and wherein a 90 degree orientation is defined wherein said plurality of fibers within said respective layer run parallel to said width of the recyclable carpet and perpendicular to said length of the recyclable carpet.

4. The method of claim 2, wherein said first direction runs in a +45 degree orientation and wherein said second direction runs perpendicular to said first direction in a −45 orientation.

5. The method of claim 1, wherein forming a fiber-reinforced primary backing comprises:

forming a glass fabric fiber layer, wherein said glass fabric fiber layer comprises a first layer formed of a plurality glass fibers, each of said plurality of glass fibers of said first layer running in a first direction, said first direction defined relative to a length and a width of the recyclable carpet; and a second layer of said plurality of glass fibers onto the first layer, each of said plurality of glass fibers of said second layer running in a second direction, said second direction also defined relative to said length and said width of the recyclable carpet;

coupling an extruded film to said glass fabric layer, said extruded film comprising a nylon film selected from the group consisting of a nylon 6 film, a nylon 66 film, and copolymers thereof;

coupling a second glass fiber layer to said fiber-reinforced extruded film such that said fiber-reinforced extruded film is between said first glass fabric layer and said second glass fabric layer, wherein said second glass fabric layer comprises a third layer formed of a plurality glass fibers, each of said plurality of glass fibers of said third layer running in a third direction, said third direction defined relative to a length and a width of the recyclable carpet; and a fourth layer of said plurality of glass fibers onto the third layer, each of said plurality of glass fibers of said fourth layer running in a fourth direction, said fourth direction also defined relative to said length and said width of the recyclable carpet; and melting said extruded film to consolidate said first glass fiber layer to said extruded film and to said second glass fiber layer.

6. The method of claim 5, wherein said first direction and said third direction each run in a 0 degree orientation and wherein said second direction and said fourth direction runs in a 90 degree orientation, wherein a 0 degree orientation is defined as running parallel to said length of the recyclable carpet and wherein a 90 degree orientation is defined as running parallel to said width of the recyclable carpet and perpendicular to said length of the recyclable carpet.

7. The method of claim 5, wherein said first direction runs in a 0 degree orientation and wherein said second direction runs in a 90 degree orientation, wherein a 0 degree orientation is defined wherein said plurality of fibers within a respective layer run parallel to said length of the recyclable carpet and wherein a 90 degree orientation is defined wherein said plurality of fibers within said respective layer run parallel to said width of the recyclable carpet and perpendicular to said length of the recyclable carpet; and wherein said third direction runs in a +45 degree orientation and wherein said fourth direction runs perpendicular to said third direction in a −45 orientation, said +45 degree orientation defined wherein said fibers within said respective layer are rotated 45 degrees clockwise with respect to fibers oriented in said 0 degree orientation.

8. A method for forming a recyclable tufted carpet comprising:

forming a glass fiber veil;

coupling an extruded film to said glass fiber veil, said extruded film comprising a nylon film selected from the group consisting of a nylon 6 film, a nylon 66 film, and copolymers thereof; and consolidating said extruded film to said glass fiber veil to form a fiber-reinforced primary backing; and tufting a plurality of pile elements tufted through fiber-reinforced primary backing, wherein said extruded film includes a plurality of dispersed glass fibers incorporated therein.

9. The method of claim 8 further comprising:

forming a glass fabric fiber layer, wherein said glass fabric fiber layer comprises a first layer formed of a plurality glass fibers, each of said plurality of glass fibers of said first layer running in a first direction, said first direction defined relative to a length and a width of the recyclable carpet; and a second layer of said plurality of glass fibers onto the first layer, each of said plurality of glass fibers of said second layer running in a second direction, said second direction also defined relative to said length and said width of the recyclable carpet;

coupling said glass fiber fabric layer to said extruded film such that said extruded film is between said glass fiber veil and said glass fiber fabric layer; and consolidating said fiber-reinforced film to said glass fiber veil and to said glass fiber fabric layer to form a fiber-reinforced primary backing.

10. The method of claim 9, wherein said first direction runs in a 0 degree orientation and wherein said second direction runs in a 90 degree orientation, wherein a 0 degree orientation is defined wherein said plurality of fibers within a respective layer run parallel to said length of the recyclable carpet and wherein a 90 degree orientation is defined wherein said plurality of fibers within said respective layer run parallel to said width of the recyclable carpet and perpendicular to said length of the recyclable carpet.

11. The method of claim 9, wherein said first direction runs in a +45 degree orientation and wherein said second direction runs perpendicular to said first direction in a −45 orientation.

12. A method for forming a recyclable tufted carpet comprising:

forming a glass fiber veil;

tufting a plurality of pile elements tufted through glass fiber veil;

coupling an extruded film to said glass fabric veil, said extruded film comprising a nylon film selected from the group consisting of a nylon 6 film, a nylon 66 film, and copolymers thereof; and consolidating said extruded film to said glass fiber veil, wherein said extruded film includes a plurality of dispersed glass fibers incorporated therein.

13. The method of claim 12 further comprising:

forming a glass fabric fiber layer, wherein said glass fabric fiber layer comprises a first layer formed of a plurality glass fibers, each of said plurality of glass fibers of said first layer running in a first direction, said first direction defined relative to a length and a width of the recyclable carpet; and a second layer of said plurality of glass fibers onto the first layer, each of said plurality of glass fibers of said second layer running in a second direction, said second direction also defined relative to said length and said width of the recyclable carpet;

coupling said glass fiber fabric layer to said extruded film.

14. The method of claim 13, wherein said first direction runs in a 0 degree orientation and wherein said second direction runs in a 90 degree orientation, wherein a 0 degree orientation is defined wherein said plurality of fibers within a respective layer run parallel to said length of the recyclable carpet and wherein a 90 degree orientation is defined wherein said plurality of fibers within said respective layer run parallel to said width of the recyclable carpet and perpendicular to said length of the recyclable carpet.

15. The method of claim 13, wherein said first direction runs in a +45 degree orientation and wherein said second direction runs perpendicular to said first direction in a −45 orientation.

16. A method for forming a recyclable tufted carpet comprising:

forming a glass fiber mat, said glass fiber mat comprising a plurality of discrete randomly oriented glass fibers;

coupling an extruded film to said glass fiber mat said extruded film comprising a nylon film selected from the group consisting of a nylon 6 film, a nylon 66 film, and copolymers thereof; and consolidating said extruded film to said glass fiber mat to form a fiber-reinforced primary backing; and tufting a plurality of pile elements tufted through fiber-reinforced primary backing, wherein said extruded film includes a plurality of dispersed glass fibers incorporated therein.

17. The method of claim 16 further comprising:

forming a glass fabric fiber layer, wherein said glass fabric fiber layer comprises a first layer formed of a plurality glass fibers, each of said plurality of glass fibers of said first layer running in a first direction, said first direction defined relative to a length and a width of the recyclable carpet; and a second layer of said plurality of glass fibers onto the first layer, each of said plurality of glass fibers of said second layer running in a second direction, said second direction also defined relative to said length and said width of the recyclable carpet;

coupling said glass fiber fabric layer to said fiber-reinforced extruded film such that said fiber-reinforced extruded film is between said glass fiber mat and said glass fiber fabric layer; and consolidating said fiber-reinforced film to said glass fiber veil and to said glass fiber fabric layer to form a fiber-reinforced primary backing.

18. The method of claim 17, wherein said first direction runs in a 0 degree orientation and wherein said second direction runs in a 90 degree orientation, wherein a 0 degree orientation is defined wherein said plurality of fibers within a respective layer run parallel to said length of the recyclable carpet and wherein a 90 degree orientation is defined wherein said plurality of fibers within said respective layer run parallel to said width of the recyclable carpet and perpendicular to said length of the recyclable carpet.

19. The method of claim 17, wherein said first direction runs in a +45 degree orientation and wherein said second direction runs perpendicular to said first direction in a −45 orientation.

* * * * *